United States Patent [19]

Worthington

[11] 4,170,211

[45] Oct. 9, 1979

[54] COMBINATION AC AND DC ELECTRICAL STARTING MOTOR FOR ENGINES

[76] Inventor: Robert W. Worthington, 713 Franklin St., Manitowoc, Wis. 54220

[21] Appl. No.: 830,338

[22] Filed: Sep. 2, 1977

[51] Int. Cl.[2] ..... F02N 17/00; F02N 11/00

[52] U.S. Cl. ..... 123/179 B; 123/179 E; 290/38 R

[58] Field of Search ..... 123/179 B, 179 D, 179 E, 123/179 M; 290/38 R; 74/7 R

[56] References Cited

U.S. PATENT DOCUMENTS

| | | | |
|---|---|---|---|
| 1,561,820 | 11/1925 | Bedford | 290/38 R |
| 1,795,030 | 3/1931 | Martineau | 123/179 B |
| 2,070,615 | 2/1937 | Plante | 123/179 E |
| 2,115,671 | 4/1938 | Pfister | 290/38 R |
| 2,123,711 | 7/1938 | Cullsen | 123/179 E |
| 3,946,260 | 3/1976 | Frezzolini et al. | 310/154 |
| 3,991,734 | 11/1976 | Martin | 123/179 E |

FOREIGN PATENT DOCUMENTS

| | | | |
|---|---|---|---|
| 567954 | 3/1945 | United Kingdom | 123/179 E |

*Primary Examiner*—Charles J. Myhre

*Assistant Examiner*—David D. Reynolds

*Attorney, Agent, or Firm*—Clarence A. O'Brien; Harvey B. Jacobson

[57] ABSTRACT

A combination AC and DC electrical starting motor system for internal combustion engines has a first portion responsive to DC current for cranking a starter motor assembly of an internal combustion engine, and a second portion responsive to AC current for cranking the starter motor assembly simultaneously with the first portion. Each of the first and second portions of the starting motor system includes an electrical motor, which may be shared with the other portion, and an electrical solenoid connectible to a source of current for actuating the motor simultaneously with actuation of the motor of the other portion. The solenoid of the first portion is connected to a source of DC current, and the solenoid of the second portion to a source of AC current in order to selectively place the associated motors in communication with the respective sources of current simultaneously with one another and assure sufficient current to the starting motor assembly to crank an internal combustion engine sufficient to start the engine, even in exceptionally cold weather.

3 Claims, 2 Drawing Figures

SWITCH
24
28
10
12
36
TRANSMISSION HOUSING
14
34
A.C. MOTOR
D.C. MOTOR
RING GEAR
SOL.
TO COIL
26
32
42
40
30
22
STARTER
ENGINE
IGN.
SWITCH
24'
BATTERY
ST.
20
SWITCH
18
16
38
SOL.
GEN. REG.

14'

46
48
34'
44
32'
14'

COMBINATION AC AND DC ELECTRICAL STARTING MOTOR FOR ENGINES

BACKGROUND OF THE INVENTION

1. Field of the Invention

This invention relates generally to internal combustion engine prime mover systems, and the like, and particularly to a starting motor system for use with such engines that will operate simultaneously off AC and DC electrical current, or from either AC or DC electrical current when only one is available.

2. Description of the Prior Art

Most starting motors used with automobile prime movers, and the like, are powered by six or twelve volt batteries. A problem with these conventional batteries is that they get too weak to give the starting motor enough power to crank the engine they are intended to start, especially in cold weather.

U.S. Pat. No. 1,561,820, issued Nov. 17, 1925, to D. J. Bedord, discloses the use of a starter motor having two portions, designated D and E, for permitting the motor to be selectively used with either house current or a suitable generator associated with an internal combustion engine being started. A difficulty encountered with this early device, however, is that only one motor, or part of a motor, can be actuated at a time even though two current sources are available. That is, either the household current, which due to the early period was not necessarily intended to be AC current, or the DC battery can be used to actuate the starter motor arrangement in any given situation.

U.S. Pat. No. 3,946,260, issued Mar. 23, 1976, to J. Frezzolini, et al., discloses a compact AC-DC motor primarily intended for use in actuating motion picture cameras, and the like, but which is typical of such AC-DC motors in that the AC and DC current cannot be applied to the motor simultaneously.

SUMMARY OF THE INVENTION

It is an object of the present invention to provide a combination AC and DC electrical starting motor system for internal combustion engine prime mover systems, and the like, which will permit the AC and DC current to be applied to the motor system simultaneously.

It is another object of the present invention to provide an AC and DC electrical starting motor system having two motors mounted on a single frame and connected directly to one another by a rigid shaft.

It is another object of the present invention to provide an AC and DC electrical starting motor system comprising a pair of separate motors connected together by means of suitable one-way clutches.

It is a still further object of the present invention to provide an AC and DC electrical starting motor system that can be wired into an existing, conventional ignition arrangement forming part of an internal combustion engine prime mover system, and the like.

These and other objects are achieved according to the present invention by providing a combination AC and DC electrical starting motor system for engines which has: a first portion responsive to DC current for cranking a starter motor assembly of an internal combustion engine to be started; and a second portion responsive to AC current for also cranking the starter motor assembly simultaneously with the first portion. Each of the first and second portions of the starting motor system includes an electrical motor and an electrical solenoid connectible to a source of current for actuating the associated electrical motor simultaneously with actuation of the other electrical motor by the other solenoid. The solenoid of the first portion is connected to a source of DC current and the solenoid of the second portion to a source of AC current so that both DC and AC current can be applied to the starting motor system simultaneously.

According to one preferred embodiment of the present invention, the starting motor system can also include a frame and a rigid drive shaft, with the motors of the first portion and second portion both being mounted on the frame and connected to one another by the drive shaft for rotating in unison. Alternatively, a second preferred embodiment of the present invention seeks to eliminate the possibility of the DC motor having to rotate the AC motor when AC current is not available by arranging the first portion and second portion as separate motors connected together by a, for example, flexible shaft and a pair of properly arranged, suitable, conventional, one-way clutches.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
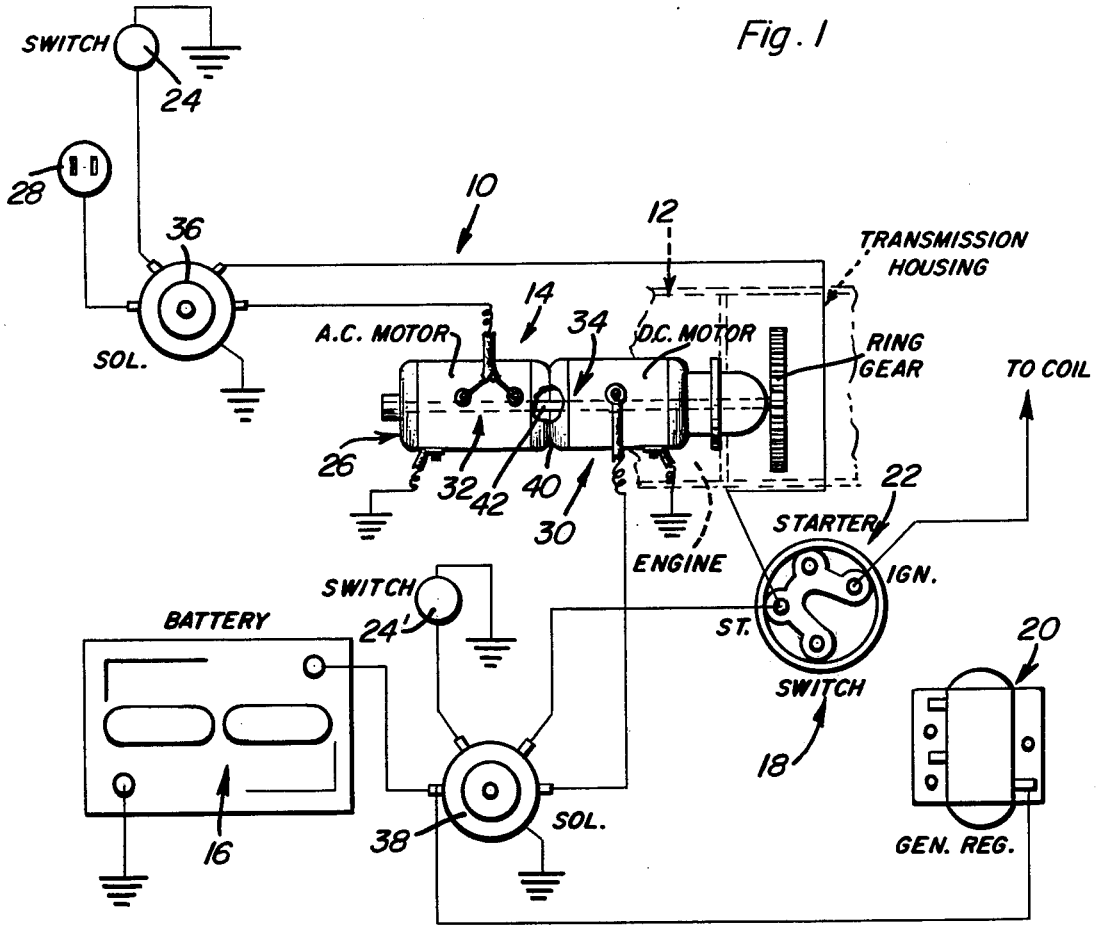
FIG. 1 is a schematic diagram showing an internal combustion engine prime mover system including a first preferred embodiment of a combination AC and DC electrical starting motor system according to the present invention.

Referring now more particularly to the embodiment of the invention seen in FIG. 1 of the drawing, an internal combustion engine prime mover system 10, and the like, includes an engine 12, a starter motor system 14 coupled to engine 12 in a conventional manner for starting engine 12, a battery 16 connected to the starter motor system 14, and an ignition assembly 18 connected to battery 16 and to starter motor assembly 14. The latter includes a conventional generator regulator 20 and a starter and ignition switch 22, with a pair of neutral safety switches 24 and 24' being included in the schematic diagram to show how these switches would be included in the circuit according to the invention when needed in conjunction with automatic transmissions, as is conventional. The elements of prime mover system 10 as discussed immediately above are conventionally parts of such a system, and it is only the specific starter motor system in accordance with the invention which will be described in detail below.

Starter motor system 14 includes a first portion 30 responsive to DC current as supplied by, for example, battery 16, and a second portion 26 responsive to AC current, for example, conventional household AC electricity, for cranking starter motor system 14 symultaneously with first portion 30. Each of the first and second portions 30 and 26 includes an electric motor 34 and 32 each having associated therewith a respective electrical solenoid 38 and 36 of conventional construction and connectible to a source of current for actuating a respective motor 34 and 32 simultaneously with actuation of the other motor 34 with the associated solenoid 38, and motor 32 with the associated solenoid 36. Solenoid 36 is connected to a source of AC current as by plug 28 and a suitable wire connecting the plug 28 to solenoid 36, while solenoid 38 is connected to battery 16, again by a suitable wire. From this description of the wiring diagram, it will be noted that both solenoids are activated simultaneously by ignition assembly 18 and starter and ignition switch 22. Solenoid 36 will be designed to deliver AC current to motor 32 even though it is activated by DC current from starter and ignition switch 22.

The neutral safety switches 24 and 24' are also connected to respective solenoids 36 and 38 as by suitable wires, and are grounded to complete an electrical circuit through the switches 24, 24'.

The starter motor system 14 as seen in FIG. 1 is mounted on a common frame 40, the details of construction of which are not important to the invention, and can have a solid one piece shaft for both motors 34 and 32 or a suitable arrangement for rigidly connecting the shaft of motor 34 to the shaft of motor 32 in a conventional manner. By this arrangement, the motors 34 and 32 will always rotate together even if only one of the motors is being energized due to, for example, a failure of battery 16, or unavailability of AC current.

Figure 2:
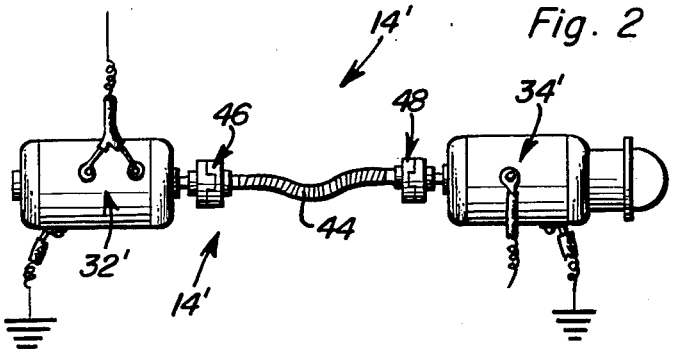
FIG. 2 is a fragmentary, schematic diagram showing part of a second preferred embodiment of a combination AC and DC electrical starting motor system that can be substituted into the internal combustion engine prime mover system as seen in FIG. 1 to replace the first preferred embodiment of the invention as seen in FIG. 1.

Referring now more particularly to FIG. 2 of the drawing, an arrangement is shown wherein the motors 34', 32' will only be coupled together if AC is being supplied to motor 32'. More specifically, this starter motor system 14' includes a preferably flexible shaft 44 having connected at either longitudinal end thereof a portion of a conventional one-way clutch 46, 48, the other portion of each of which clutches 46, 48 is fixed to the output shaft of a respective motor 32', 34'. As can be appreciated, this system 14' will include solenoids similar to solenoids 36 and 38 and can be substituted for starter motor system 14 within the conventional prime mover system 10.

As can be readily understood from the above description and from the drawing, a combination AC and DC starting motor system according to the present invention permits AC and DC current to be applied to a starter motor simultaneously for assuring sufficient power in the starter motor for cranking over an associated internal combustion engine, and the like, and assuring cold starts even on very cold mornings or other times when the battery power may be low and/or the engine having a high resistance to starting.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an internal combustion engine prime mover system including an internal combustion engine, starter motor means coupled to the engine for starting the engine, a battery connected to the starter motor means, and an ignition system connected to the battery and to the starter motor means for controlling the starter motor means, the improvement wherein the starter motor means comprises, in combination:

(a) first means responsive to a first current for actuating the starter motor means;

(b) second means responsive to a second current different from the first current for actuating the starter motor means simultaneously with the first means; wherein each of the first means and second means comprises, in combination:

(1) an electric motor; and (2) an electrical solenoid connectible to a source of current for selectively actuating the motor simultaneously with actuating of the motor of the other of the first and second means by the solenoid of the other of the first and second means, the solenoid of the first means being actuatable by a DC current for supplying DC current to its respective motor, and the solenoid of the second means being actuatable by a DC current for supplying AC current to its respective motor, the DC and AC current forming the first current and second current, respectively; and wherein said ignition system includes an ignition switch which is electrically connected to said electrical solenoid of said first means and said electrical solenoid of said second means for effecting actuation of each solenoid by supplying DC current thereto for simultaneously actuating each solenoid.

2. A structure as defined in claim 1, wherein the system further includes a frame and a drive shaft, with the motors of the first means and second means both being mounted on the frame such that an output shaft of the motor of the first means is coaxial with an output shaft of the motor of the second means, the output shaft of the motor of the first means being connectible to an engine to be started, and the drive shaft connecting together the output shafts of each of the motors so that the output shafts rotate with one another.

3. A structure as defined in claim 1, wherein the motor of the first means and the motor of the second means are separate from one another and are coupled together by a pair of one-way clutches connected to a flexible drive shaft.

* * * * *